US006257802B1

(12) United States Patent
Vosbikian

(10) Patent No.: US 6,257,802 B1
(45) Date of Patent: Jul. 10, 2001

(54) PACKAGING ARRANGEMENTS FOR ROCK STABILIZER SETS

(75) Inventor: Jack Vosbikian, Cherry Hill, NJ (US)

(73) Assignee: International Rollforms Incorporated, Deptford, NJ (US)

( * ) Notice: Subject to any disclaimer, the term of this patent is extended or adjusted under 35 U.S.C. 154(b) by 0 days.

(21) Appl. No.: 09/461,584

(22) Filed: Dec. 15, 1999

(51) Int. Cl.[7] ..... E21D 20/00; B65B 35/56

(52) U.S. Cl. ..... 405/259.3; 405/259.1; 405/303; 53/143; 53/149

(58) Field of Search ..... 405/258, 259.1, 405/259.3, 272, 274, 277, 278, 303; 53/148, 149, 155, 157, 443, 444, 445, 446, 143; 52/155; 206/443

(56) References Cited

U.S. PATENT DOCUMENTS

| | | | | |
|---|---|---|---|---|
| 3,283,893 | * | 11/1966 | Durocher et al. | 100/2 |
| 4,265,571 | | 5/1981 | Scott . | |
| 4,313,695 | * | 2/1982 | McCartney | 405/259 |
| 4,382,719 | | 5/1983 | Scott . | |
| 4,445,808 | | 5/1984 | Arya . | |
| 4,652,178 | | 3/1987 | Kates et al. . | |
| 4,984,689 | * | 1/1991 | Emalfarb et al. | 206/499 |
| 5,192,146 | * | 3/1993 | Landsberg | 405/259.1 |
| 5,214,902 | * | 6/1993 | Jones | 53/413 |
| 5,295,768 | | 3/1994 | Buchhorn et al. . | |

OTHER PUBLICATIONS

Simmons–Rand, The Split Set System Brochure, 1990.

* cited by examiner

*Primary Examiner*—Robert E. Pezzuto
*Assistant Examiner*—Gary S. Hartmann
(74) *Attorney, Agent, or Firm*—Norman E. Lehrer

(57) ABSTRACT

A package of rock stabilizer sets and a method for arranging the sets where six sets are provided and each set includes an elongated tube and a bearing plate. Each tube has a tapered end, an end with a flange, and a slit running the length of the tube. Each bearing plate has a flat base and a central domed section having a central aperture therethrough. In a first embodiment, the tubes of four of the sets are arranged in a first or bottom layer so that the flanged and tapered ends of the tubes are aligned alternatively and the slits face downwardly. Next, the plates of three of the sets are placed along the length of the four tubes so that the domed sections face upwardly, thereby forming a second layer. A third layer is formed by placing the three remaining plates on top of the first three plates, respectively, so that the domed sections of the second layer nest within the respective domed sections of the third layer. Then, the remaining two tubes are layered in a fourth or top layer on the flat base of each of the plates of the third layer so that the domed sections are exposed and the flanged end of one tube is aligned with the tapered end of the other tube. The sets may then be bound with a strap or the like. In a second embodiment, the tubes may be longer than the tubes of the first embodiment so that all of the plates are placed along the length of the bottom layer of tubes, thereby forming one layer of plates as opposed to two layers as in the first embodiment.

10 Claims, 3 Drawing Sheets

PACKAGING ARRANGEMENTS FOR ROCK STABILIZER SETS

BACKGROUND OF THE INVENTION

The present invention is directed toward an arrangement for packaging rock stabilizers and more particularly, toward a method for arranging the rock stabilizers so that they can be easily and conveniently carried.

Ground support, especially in the mining industry, is an important safety factor that must be taken into consideration during any type of excavating activity. An effective anchoring system that is currently being used and commonly referred to as rock stabilizers includes a tube and a bearing plate, as seen, for example, in FIG. 1. The tube is typically made from resilient steel and has a slit along its length so that the tube will be compressible for insertion into a pre-drilled bore in a mine roof or wall as will be discussed below. One end of the tube is tapered and the other end has a ring flange. The tubes may vary in length. The bearing plate has a flat base from which a central domed section arises. The center of the domed section has an aperture therethrough.

In order to install the system, the bearing plate is placed against a surface to be supported, such as a wall or roof of a mine, with the domed section facing away from the surface. The tapered end of the tube is then driven through the aperture and as the tube slides into place, the slot narrows. The tube exerts radial pressure against the surface over its full contact length and provides plate load support. The result is a tight grip which actually grows stronger with time and ground movement. Similar systems are described in greater detail in the following patents: U.S. Pat. No. 5,295,768 to Buchhorn et al., U.S. Pat. No. 4,652,178 to Kates et al., U.S. Pat. No. 4,445,808 to Arya, and U.S. Pat. No. 4,382,719 to Scott.

While the above-described system is well known and used and provides an effective anchoring system, the same can be cumbersome to transport. That is, carrying the tubes and plates from one location to another location as they are needed can become time-consuming and burdensome. Currently, the tubes are packaged or otherwise bound together. Likewise, the plates are bound together by a wire or the like where the wire is drawn through the central apertures of the plates and secured. This packaging system, however, can be time-consuming because the tubes and the plates are packaged separately. Furthermore, as a result of the size of the tubes, it becomes difficult to transport a great number of tubes and plates at one time. This awkwardness makes it necessary for a person to make frequent trips from the actual work site to where the supply of tubes and plates are kept. This creates extra work and effort for the worker which wastes time and energy. Therefore, there is a need for an efficient packaging system which saves the worker's time and energy when installing the anchoring system at a work site.

SUMMARY OF THE INVENTION

The present invention is designed to overcome the deficiencies of the prior art discussed above. It is an object of this invention to provide an arrangement for packaging rock stabilizers which makes them easy to transport.

It is a further object of the present invention to provide a packaging system which conserves the energy and time of a person installing the rock stabilizers.

In accordance with the illustrative embodiments demonstrating features and advantages of the present invention, there is provided in a first embodiment, a package of rock stabilizer sets and a method for arranging the sets where six sets are provided and each set includes an elongated tube and a bearing plate. Each tube has a tapered end, an end with a flange, and a slit running the length of the tube. Each bearing plate has a flat base and a central domed section having a central aperture therethrough. The tubes of four of the sets are arranged in a first or bottom layer so that the flanged and tapered ends of the tubes are aligned alternatively and the slits face downwardly. For example, the flanged end of a first tube is placed next to the tapered end of a second tube and a flanged end of a third tube is placed next to the tapered end of the second tube. Next, the plates of three of the sets are placed along the length of the four tubes so that the domed sections face upwardly, thereby forming a second layer. A third layer is formed by placing the three remaining plates on top of the first three plates, respectively, so that the domed sections of the second layer nest within the respective domed sections of the third layer. Then, the remaining two tubes are placed on the flat base of each of the plates of the third layer so that the domed sections are exposed and the flanged end of one tube is aligned with the tapered end of the other tube, thereby forming a fourth or top layer. The sets may then be bound with a strap or the like. In this manner, the sets are easily carried and placed where needed.

In a second embodiment, the tubes may be longer than the tubes of the first embodiment so that all six of the plates are placed along the length of the bottom layer of tubes, thereby forming one layer of plates as opposed to two layers as in the first embodiment.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 2:
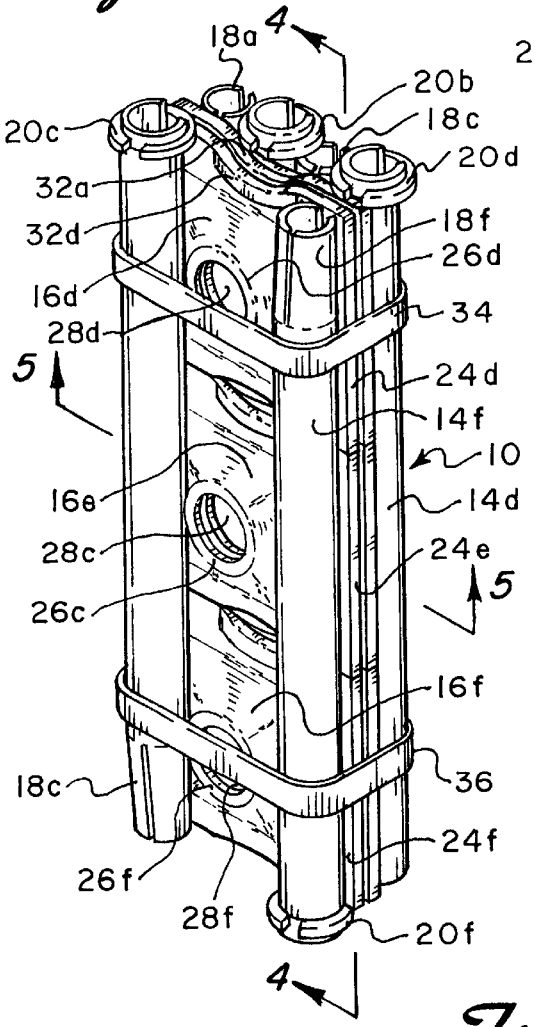
FIG. 2 is a top perspective view of a first embodiment of the packaging arrangement of the present invention for a plurality of stabilizer sets.

Referring now to the drawings in detail wherein like reference numerals have been used throughout the various figures to designate like elements, there is shown in FIG. 2 a first embodiment an arrangement for packaging rock stabilizer sets constructed in accordance with the principles of the present invention and designated generally as 10.

Figure 1:
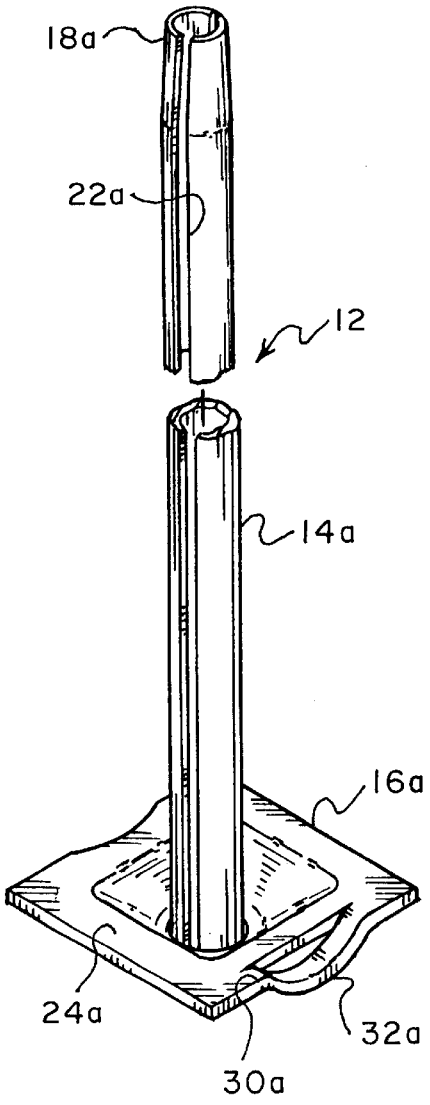
FIG. 1 is a perspective view of a currently known and used rock stabilizer set which includes an elongated tube and a bearing plate.

The present invention includes a plurality of rock stabilizer sets. One such set 12 is illustrated in FIG. 1. Each set consists of an elongated tube 14*a* and a bearing plate 16*a*. Each tube 14*a* has a tapered end 18*a*, an end having a flange 20*a*, and a slit 22*a* running the length of the tube 14*a*. Each bearing plate 16*a* has a generally square, flat base 24*a* and a domed section 26*a* arising or extending upwardly from the center of the base 24*a*. The domed section 26*a* has a central aperture 28*a* therethrough. Centrally located along one edge 30*a* of the base 24*a* is a curved raised portion which forms a hanger loop 32*a*. (See FIG. 1.) Each tube may be from approximately 18 to approximately 120 inches in length. The dimensions of each plate may be from approximately 5 inches by 5 inches to approximately 6 inches by 6 inches.

Figure 3:
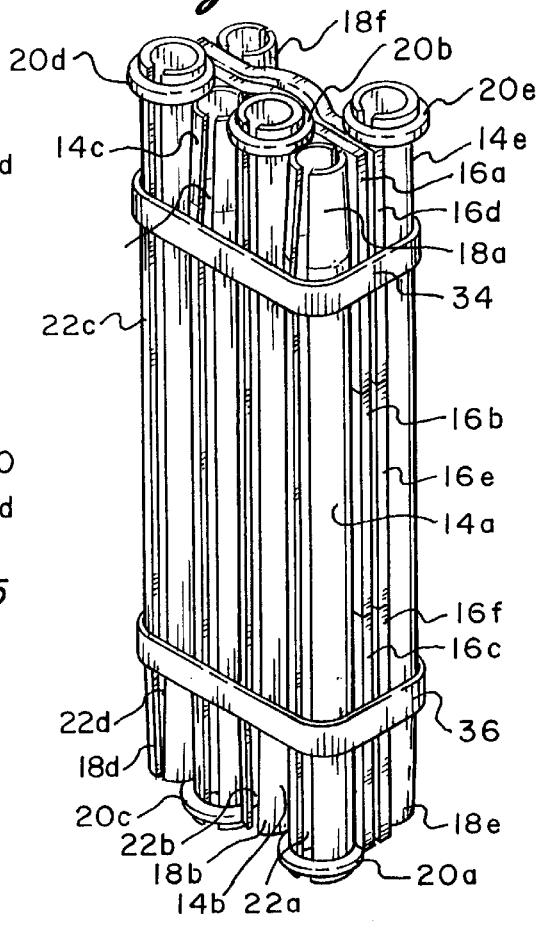
FIG. 3 is a bottom perspective view of a first embodiment of the packaging arrangement of the present invention.
Figure 4:
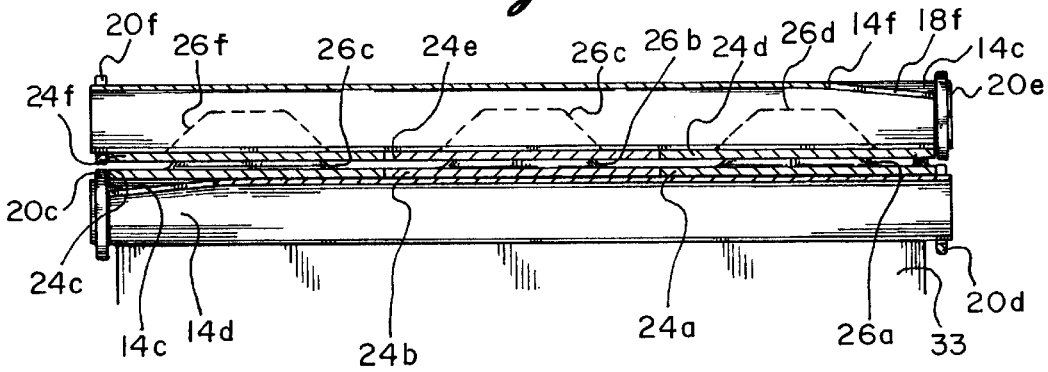
FIG. 4 is a cross-sectional view taken through line 4—4 of FIG. 2.
Figure 5:
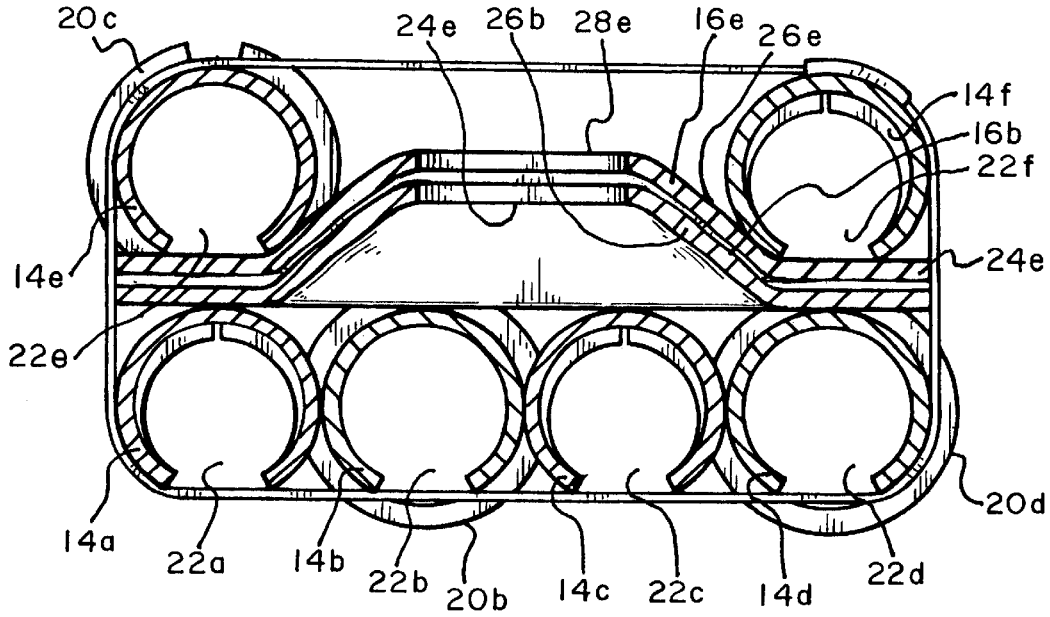
FIG. 5 is a cross-sectional view taken through line 5—5 of FIG. 2.

In order to package the sets according to the first embodiment of the present invention, preferably six sets are packaged together, i.e., six plates 16*a*–16*f* and six tubes 14*a*–14*f*. Four of the tubes 14*a*–14*d* are arranged side by side, forming a first or bottom layer, so that the flanged ends and tapered ends of the tubes are aligned alternatively. For example, the flanged end 20*a* of the first tube 14*a* is placed next to the tapered end 18*b* of the second tube 14*b* and the flanged end 20*c* of the third tube 14*c* is placed next to the tapered end 18*b* of the second tube 14*b* and the tapered end 18*d* of the fourth tube 14*d* is placed next to the flanged end 20*c* of the third tube 14*c*. (See FIG. 3.) Such an arrangement necessarily results in the tapered ends 18*a* and 18*c* of the tubes 14*a* and 14*c*, respectively, being similarly aligned with the flanged ends 20*b* and 20*d* of the tubes 14*b* and 14*d*, respectively. Also, the slits 22*a*–22*d* should face downwardly to provide support and to prevent the tubes from rolling off of a planar surface 33 when assembling the package. (See FIGS. 4 and 5.)

Next, three of the plates 16*a*–16*c* are placed along the length of the tubes 14*a*–14*d* so as to form a second layer. The domed sections of the plates face upwardly. A third layer is formed by placing the three remaining plates 16*d*–16*f* on top of the three plates 16*a*–16*c*, respectively, so that the domed sections 26*a*–26*c* of the plates 16*a*–16*c*, respectively, of the second layer nest within the respective domed sections 26*d*–26*f* of the plates 16*d*–16*f*, respectively, of the third layer and the hanger loop sections of the plates 16*a*–16*c* nest within the respective hanger loop sections of the plates 16*d*–16*f*. (See FIG. 4.) This is also seen, for example, in FIG. 5 where domed section 26*b* of plate 16*b* nests within domed section 26*e* of plate 16*e* and in FIG. 2 where hanger loop section 32*a* of plate 16*a* nests within hooked section 32*d* of plate 16*d*. In this manner, the central apertures all face upwardly, seen, for example at 28*d*–28*f* in FIG. 2.

Then, the remaining two tubes 14*e* and 14*f* are placed on the flat bases 24*d*–24*f* of each of the plates 16*d*–16*f*, respectively, so that the domed sections 26*d*–26*f* are exposed and the flanged end 20*e* of the tube 14*e* is aligned with the tapered end 18*f* of the tube 14*f*. Necessarily, tapered end 18*e* of the tube 14*e* is aligned with flanged end 20*f* of tube 14*f*. (See FIG. 2.) The slits 22*e* and 22*f* face downwardly to prevent the tubes 14*e* and 14*f* from rolling off of the flat bases 24*d*–24*f* during assembly. Thus, a fourth or top layer is formed. The sets may then be bound with straps 34 and 36 or the like. In this manner, the sets may be easily carried and placed where needed.

Figure 6:
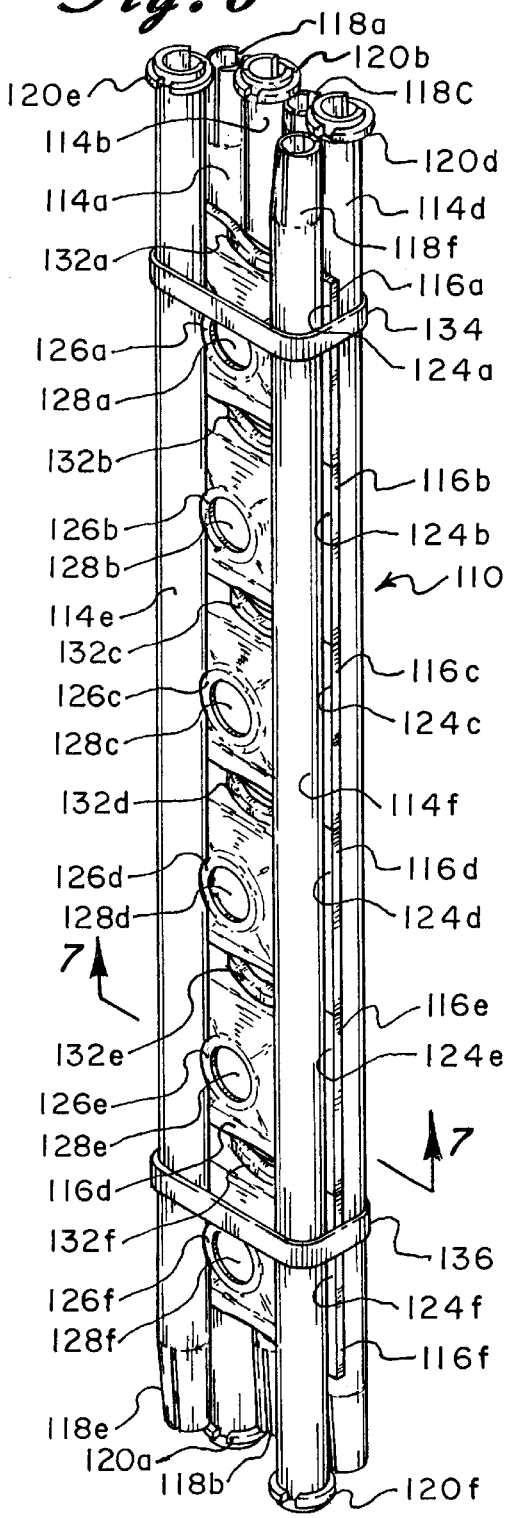
PRIOR ART Fig. 6
FIG. 6 is a top perspective view of a second embodiment of the packing arrangement of the present invention for a plurality of stabilizer sets.
Figure 7:
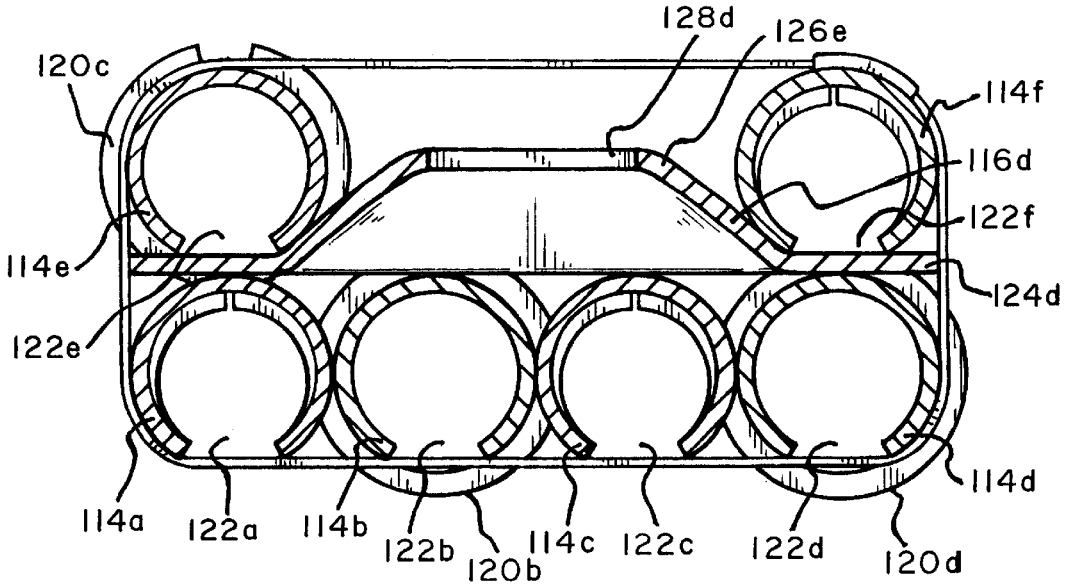
FIG. 7 is a cross-sectional view taken through line 7—7 of FIG. 6.

A second embodiment of the present invention is seen in FIGS. 6 and 7. The arrangement 110 in this embodiment is similar to the arrangement in the first embodiment with the differences noted below. The length of each of the tubes 114*a*–114*f* in this embodiment is greater than the length of the tubes in the first embodiment. The tubes 114*a*–114*f* in the first layer are placed next to each other in the same manner that the tubes in the first layer are placed. That is, the tapered end 118*a* of the first tube 114*a* is placed next to the flanged end 120*b* of the second tube 114*b* and the tapered end 118*c* of the third tube 114*c* is placed next to the flanged end 120*b* of the second tube 114*b* and the flanged end 120*d* of the fourth tube 114*d* is placed next to the tapered end 118*c* of the third tube 114*c*. (See FIG. 6.) Again, such an arrangement necessarily results in the flanged ends 120*a* and 120*c* of tubes 114*a* and 114*c*, respectively, to be similarly aligned with the tapered ends 118*b* and 118*d* of tubes 114*b* and 114*d*, respectively. Slits 122*a*–122*d* face downwardly. (See FIG. 7.)

Next, the six plates 116*a*–116*f* are then placed along the length of the tubes 114*a*–114*f* with the domed sections 126*a*–126*f* and central apertures 128*a*–128*f* of each of the plates 116*a*–116*f*, respectively, facing upwardly, and the hanger loop sections 132*a*–132*f* all facing in the same direction, thereby forming the second layer. The third layer is formed by the tubes 114*e* and 114*f* being placed on the flat bases 124*a*–124*f* of the plates 116*a*–116*f*, respectively, so that the domed sections 126*a*–126*f* are exposed and the flanged end 120*e* of the tube 114*e* is aligned with the tapered end 118*f* of the tube 114*f*. Likewise, tapered end 118*e* of tube 114*e* is aligned with flanged end 120*f* of plate 114*f*. (See FIG. 6.) The slits 122*e* and 122*f* face downwardly. (See FIG. 7.) Thus, a top or third layer is formed. The sets may then be bound with straps 134 and 136 or the like. In this manner, the rock stabilizer sets are easily carried and placed where needed.

The present invention may be embodied in other specific forms without departing from the spirit or essential attributes thereof and accordingly, reference should be made to the appended claims rather than to the foregoing specification as indicating the scope of the invention.

I claim:

1. A package of rock stabilizer sets comprising:

six rock stabilizer sets, each of said sets including an elongated tube having a tapered end, an end with a flange, and a slit running the length of said tube, each set further including a bearing plate with a base and a central domed section extending upwardly from the center of said base, said domed section having an aperture located in the center thereof;

a first layer comprised of four of said tubes placed side by side so that said flanged ends of said tubes are aligned alternatively with said tapered ends of said tubes and said slits face downwardly;

a second layer comprised of three of said plates arranged side by side on top of said first layer so that said domed sections face upwardly;

a third layer comprised of the remaining three plates arranged side by side on top of said second layer so that said domed sections face upwardly;

a fourth layer comprised of the remaining two tubes arranged on top of said third layer with said slits facing downwardly and said two tubes positioned on each of the bases of said plates comprising said third layer; and binding means securing said layers together.

2. The package of rock stabilizer sets of claim 1 wherein each of said domed sections of the plates of said second layer nest within a respective domed section of the plates of said third layer.

3. The package of rock stabilizer sets of claim 1 wherein said binding means includes two straps.

4. A package of rock stabilizer sets comprising:

six rock stabilizer sets, each of said sets including an elongated tube having a tapered end, an end with a flange, and a slit running the length of said tube, each set further including a bearing plate with a base and a central domed section extending upwardly from the center of said base, said domed section having an aperture located in the center thereof;

a first layer comprised of four of said tubes placed side by side so that said flanged ends of said tubes are aligned alternatively with said tapered ends of said tubes and said slits face downwardly;

a second layer comprised of said plates arranged side by side on top of said first layer so that said domed sections face upwardly;

a third layer comprised of the remaining two tubes arranged on top of said second layer with said slits facing downwardly and said two tubes positioned on each of the bases of said plates comprising said second layer; and binding means securing said layers together.

5. The package of rock stabilizer sets of claim 4 wherein said binding means includes two straps.

6. A method for arranging a plurality of rock stabilizer sets comprising the steps of:

providing six rock stabilizer sets, each of said sets including an elongated tube having a tapered end, an end with a flange, and a slit running the length of said tube, each set further including a bearing plate with a base and a central domed section extending upwardly from the center of said base, said domed section having an aperture located in the center thereof;

forming a first layer by positioning four of said tubes side by side so that said flanged ends of said tubes are aligned alternatively with said tapered ends of said tubes and said slits face downwardly;

forming a second layer by positioning three of said plates side by side on top of said four tubes so that said domed sections face upwardly;

forming a third layer by positioning the remaining three plates side by side on top of said second layer so that said domed sections face upwardly;

forming a fourth layer by positioning the remaining two tubes on top of said bases of each of said plates comprising the third layer with each of said slits of said two tubes facing downwardly; and binding said layers together.

7. The method for arranging a plurality of rock stabilizer sets of claim 6 wherein said step of forming said third layer includes nesting each of said domed sections of the plates of said second layer within a respective domed section of the plates of said third layer.

8. The method for arranging a plurality of rock stabilizer sets of claim 6 wherein said step of binding said layers together includes using two straps.

9. A method for arranging a plurality of rock stabilizer sets comprising the steps of:

providing six rock stabilizer sets, each of said sets including an elongated tube having a tapered end, an end with a flange, and a slit running the length of said tube, each set further including a bearing plate with a base and a central domed section extending upwardly from the center of said base, said domed section having an aperture located in the center thereof;

forming a first layer by positioning four of said tubes side by side so that said flanged ends of said tubes are aligned alternatively with said tapered ends of said tubes and said slits face downwardly;

forming a second layer by positioning said plates side by side on top of said four tubes so that said domed sections face upwardly;

forming a third layer by positioning the remaining two tubes on top of said bases of each of said plates comprising the second layer with each of said slits of said two tubes facing downwardly; and binding said layers together.

10. The method for arranging a plurality of rock stabilizer sets of claim 9 wherein said step of binding said layers together includes using two straps.

* * * * *